US006324700B1

(12) United States Patent
McDougall

(10) Patent No.: US 6,324,700 B1
(45) Date of Patent: Dec. 4, 2001

(54) ADJUSTABLE PROTECTIVE HELMET

(75) Inventor: Todd McDougall, Montreal (CA)

(73) Assignee: Bauer Nike Hockey Inc., Montreal (CA)

( * ) Notice: Subject to any disclaimer, the term of this patent is extended or adjusted under 35 U.S.C. 154(b) by 0 days.

(21) Appl. No.: 09/722,095

(22) Filed: Nov. 24, 2000

(30) Foreign Application Priority Data

Nov. 24, 1999 (CA) ..... 2290324

(51) Int. Cl.[7] ..... A42B 1/22
(52) U.S. Cl. ..... 2/417; 2/414; 2/420
(58) Field of Search ..... 2/417, 418, 419, 2/420, 425, 414, 412, 411

(56) References Cited

U.S. PATENT DOCUMENTS

| | | | |
|---|---|---|---|
| 3,579,637 | | 5/1971 | Aileo . |
| 3,665,514 | * | 5/1972 | Durand . |
| 3,820,163 | | 6/1974 | Rappleyea . |
| 4,282,610 | | 8/1981 | Steigerwald et al. . |
| 4,404,690 | | 9/1983 | Farquharson . |
| 4,477,929 | * | 10/1984 | Mattsson . |
| 4,827,537 | | 5/1989 | Villa . |
| 5,272,773 | | 12/1993 | Kamata . |
| 5,511,250 | | 4/1996 | Field et al. . |
| 5,628,071 | | 5/1997 | Nezer . |
| 6,108,824 | * | 8/2000 | Fournier et al. . |
| 6,138,283 | * | 10/2000 | Kress . |

FOREIGN PATENT DOCUMENTS

| | | | |
|---|---|---|---|
| 3727701 | * | 3/1989 | (DE) . |
| 0 346 608 | | 12/1989 | (EP) . |
| 7-109609 | | 4/1995 | (JP) . |
| WO 98/23174 | | 6/1998 | (WO) . |

* cited by examiner

*Primary Examiner*—Rodney M. Lindsey
(74) *Attorney, Agent, or Firm*—Ratner & Prestia

(57) ABSTRACT

An adjustable protective helmet for sporting activities comprising a first shell and second shell, having respective cooperating inner and outer overlapping portions extending transversely across the top portion of the wearer's head for connecting together the shells to form a bowl shaped shell assembly circumscribing the wearer's head. The shells are movable relative to one another in the overlapping portions to provide size adjustability of the helmet. The helmet includes a shock absorbing liner inside the shell assembly. The shell assembly comprises a ramp defined by a plurality of raised formations on the inside surface of the shell assembly, that is adjacent and facing a free edge of the inner overlapping portion thereby increasing the contact surface area between the liner and the shell assembly around said overlapping portions in order to reduce the concentration of force of an impact in the vicinity of the overlapping portions.

14 Claims, 11 Drawing Sheets

ADJUSTABLE PROTECTIVE HELMET

FIELD OF THE INVENTION

The present invention relates to an adjustable protective helmet for sporting activities and more particularly, to an improved adjustable helmet for use by hockey players.

BACKGROUND OF THE INVENTION

Protective helmets comprising adjustability features are well known. In this regard, it is known to provide an adjustable helmet having two shell portions that are held together by screws. The loosening and tightening of the screws allow for adjustment of the helmet. In use, the two shell portions are fixedly held together, thus are adapted to move relative to one another when the screws are loosened. When the desired size is obtained, the screws are tightened and the two shell portions are locked in place. The two shell portions usually have overlapping surfaces to enable the shell portions to be moved relative to one another while not leaving any gap between the two shell portions. Shock-absorbing foam padding is positioned inside the helmet shells to cushion the wearer's head. For practical reasons, there are usually two sections of padding: One section of padding being attached to each shell portion of the protective helmet. This arrangement simplifies the assembly of padding and shell portions and also facilitates assembly of the components.

An important drawback of this known configuration is that the overlapping surfaces of the two shell portions create a step or ridge on the inner surface of the shell assembly directly above the head of the player. More particularly, in the area of the separation of the two shell portions, the interior curvature of the helmet shell is broken by the feature of adjustability of the helmet. This seems to create an area of concentration of forces. When an impact occurs, the step or ridge has a tendency to dig into the foam padding and apply a localized force to the head of the wearer, which is highly undesirable in a protective helmet. A protective helmet's main task is to spread the force of impact to as wide a surface as possible without bottoming out, in order to absorb impact and prevent injuries to the cranium.

A second drawback of this known configuration of an adjustable helmet is the reduced amount of foam padding at the junction of two padding sections. For practical reasons, the foam padding sections separation coincides with the shell portions separation. This arrangement entails that when the shell portions are spaced apart, a gap is formed between the padding sections in the area where the two shell portions overlap each other. As a result, certain circumstances may leave an area of the cranium with insufficient shock-absorbing foam padding and therefore more limited protection. Some helmets have been designed with no padding separation. The necessary gap for adjusting the shell portions is located at the back of the head which may leave the back portion of the cranium with insufficient shock-absorbing foam padding.

OBJECTS AND STATEMENT OF THE INVENTION

It is therefore an object of the invention to provide an adjustable protective helmet having an improved shell assembly, which overcome some of the disadvantages of the prior art.

It is another object of the invention to provide an adjustable protective helmet, which is adapted to reduce the concentration of force during impact absorption.

As embodied and broadly described herein, the invention provides an adjustable protective helmet for sporting activities comprising a first shell and second shell. One of the shells covering the forehead and a portion of the sides of a wearer's head, and the other one of said shells covering the top, back and a portion of the sides of a wearer's head. The first and second shells have respective cooperating inner and outer overlapping portions extending transversely across the top portion of the wearer's head for connecting together the shells to form a bowl shaped shell assembly circumscribing the wearer's head. The inner overlapping portion is disposed inwardly of the outer overlapping portion and its associated shell; the shells are movable relative to one another in the overlapping portions to provide size adjustability of the helmet. The helmet includes a shock absorbing liner inside the shell assembly. The shell assembly comprises a ramp defined by a plurality of raised formations on the inside surface of the shell assembly. The ramp is positioned next to a free edge of the inner overlapping portion thereby increasing the contact surface area between the liner and the shell assembly in the vicinity of the overlapping portions in order to reduce the risk of a the concentration of forces during impact over the head of the wearer.

Advantageously, the ramp is located in the central portion of the inside surface of the shell assembly and the raised formations that forms the ramp define a plane which is substantially co-planar with the inside surface of the inner overlapping portion. This arrangement provides an even surface of contact between the liner and the shell assembly in the area around the overlapping portions.

Preferably, the raised formations are a series of ribs extending longitudinally from the overlapping portions. The series of ribs decreases in height from the overlapping portions to blend with an inner curvature of the shell assembly.

Other objects and features of the invention will become apparent by reference to the following description and the drawings.

BRIEF DESCRIPTION OF THE DRAWINGS

A detailed description of the preferred embodiments of the present invention is provided herein below, by way of example only, with reference to the accompanying drawings, in which.

Figure 1:
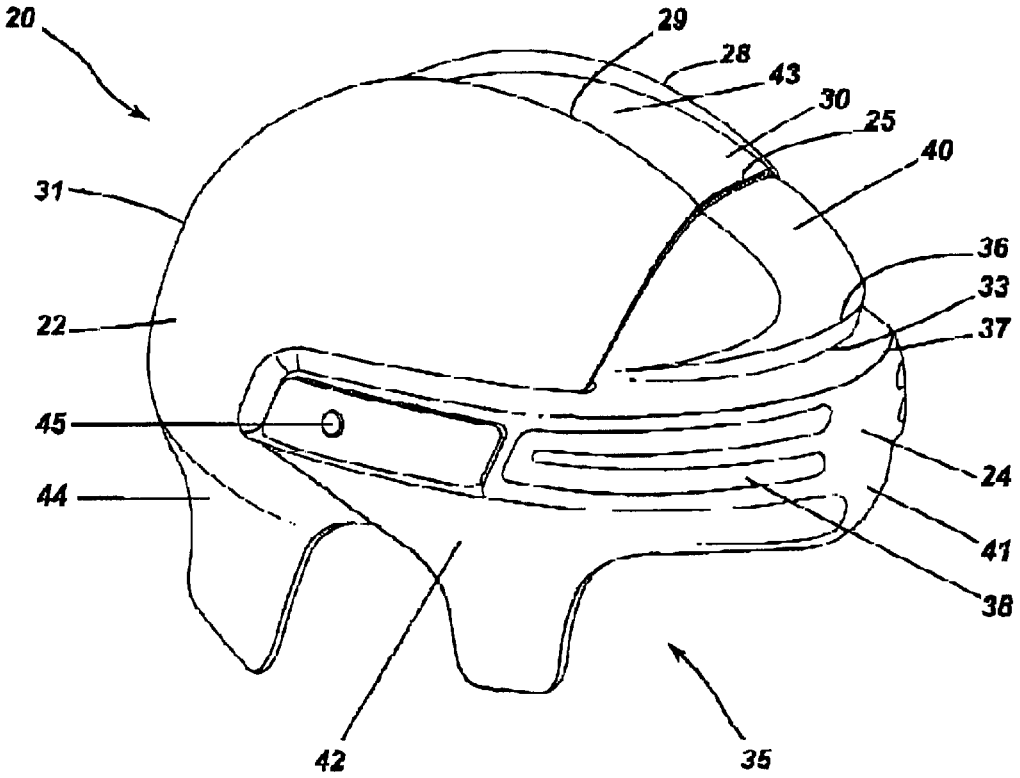
FIG. 1 is a perspective view of an adjustable protective helmet.

In the drawings, preferred embodiments of the invention are illustrated by way of examples. It is to be expressly understood that the description and drawings are only for the purpose of illustration and are an aid for understanding. They are not intended to be a definition of the limits of the invention.

DETAILED DESCRIPTION OF PREFERRED EMBODIMENTS

FIGS. 1 illustrates an adjustable protective helmet referred to as 20 comprising a back shell 22 and a front shell 24 interlocked together in an overlapping area 25 to form a bowl shaped shell assembly 35 circumscribing the wearer's head. Front shell 24 covers the forehead and a portion of the sides of a wearer's head, while back shell 22 covers the top, back and a portion of the sides of a wearer's head. Front and back shells 22 and 24 are movable relative to one another as described hereinafter.

Front shell 24 comprises a top wall portion 40 and a frontal portion 41 that extends into side portions 42 covering the sides of helmet 20. Similarly, back shell 22 comprises a top wall portion 43 and side portions 44. Top wall 43 comprises a pair of ridges 28 and 29 extending from the front portion 30 of back shell 22 to the back portion 31 of back shell 22. These ridges 28 and 29 are areas of increased geometry adapted to augment the impact absorbing capacity of the protective helmet 20 from shock in the top and back of the wearer's head. Similarly, an area of increased geometry is located on front shell 24 and is formed by recess 33 which gives rise to a pair of ridges 36 and 37 providing added protection to the front portion of the wearer'head. Front and back shells 22 and 24 may also feature air vents in recesses 38 to provide adequate ventilation and help cool the wearer's head. Front and rear shells 22 and 24 are made of suitable impact resistant material such as polyethylene.

Figure 1A:
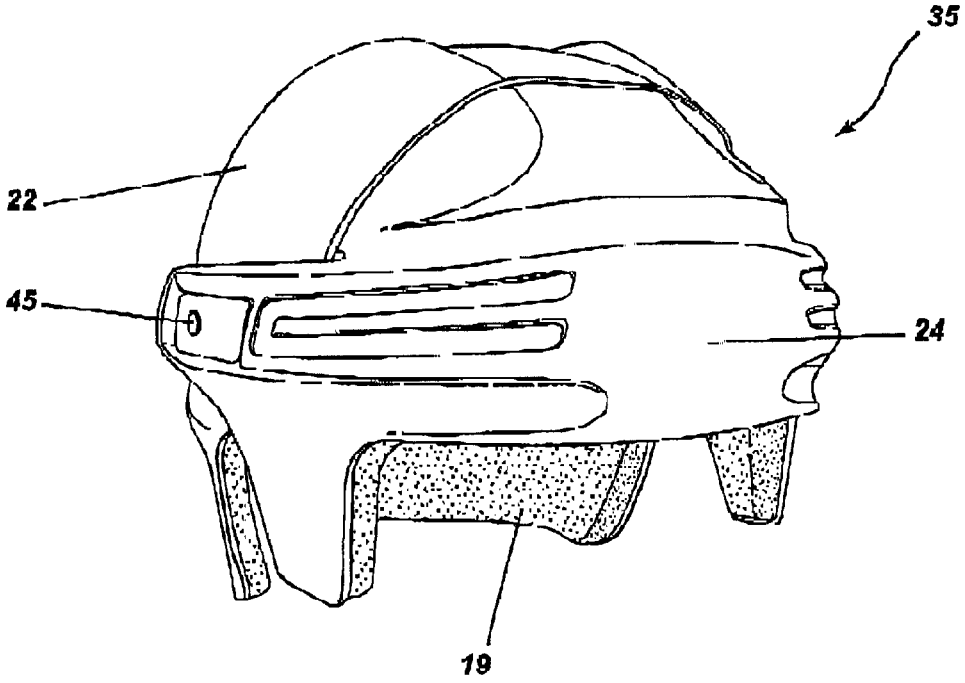
FIG. 1A is a perspective view of an adjustable protective helmet with a interior lining.

As shown in FIG. 1, When front and back shells 22 and 24 engage one another, top wall portion 40 of front shell 24 is located underneath top wall portion 43 of back shell 22 while the side portion 42 of front shell 24 are located over the side portions 44 of back shell 22. Front and rear shells 22 and 24 are locked together using screws 45 located on each side of helmet 20 which fasten together side portions 42 and 44. Other types of mechanical links may be used as locking means such as for example, a cam and lever assembly combined with a plurality of corresponding teeth on each side portions 42 and 44 which lock together when pressed together by the cam and lever assembly. Other means of locking shells 22 and 24 are well known in the art of helmet construction. Front and rear shells 22 and 24 are adapted to move relative to one another when screws 45 are loosened. When the desired helmet size is reached, screws 45 are tightened and front and rear shells 22 and 24 are locked in place. As shown in FIG. 1A, helmet 20 also comprises a shock absorbing liner 19 position inside shell assembly 35. Shock absorbing liner 19 is made of a foam material, preferably a vinyl nitryle of a thickness ranging from 10 to 20 mm.

Figure 2:
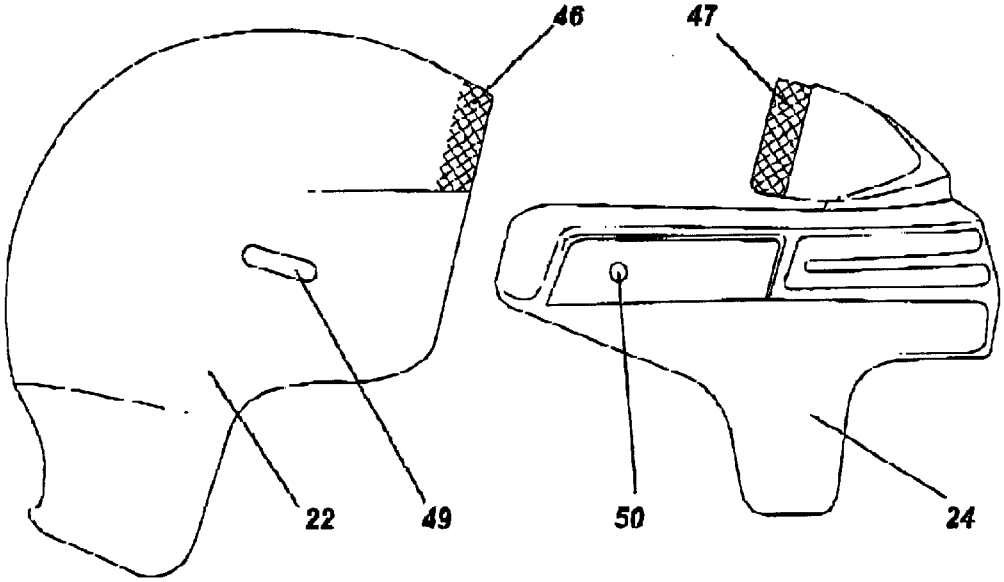
FIG. 2 is a side elevational view of the two shells making up an adjustable protective helmet.

FIG. 2 illustrates front and rear shells 22 and 24 before they are connected together. Back shell 22 comprises a slot 49 while front shell 24 comprises a single aperture 50. When connected together, slot 48 is aligned with aperture 50 and a screw 45 is inserted to tighten shells 22 and 24 together. When assembled, each shell 22 and 24 has an overlapping portion corresponding to the hatched area 46 and 47 defining the overall range of adjustability of helmet 20. Overlapping portions 46 and 47, combined with the slot 49 and aperture 50 arrangement, cooperate to allow relative movement between shells 22 and 24 to provide adjustability of the size of helmet 20.

Figure 3:
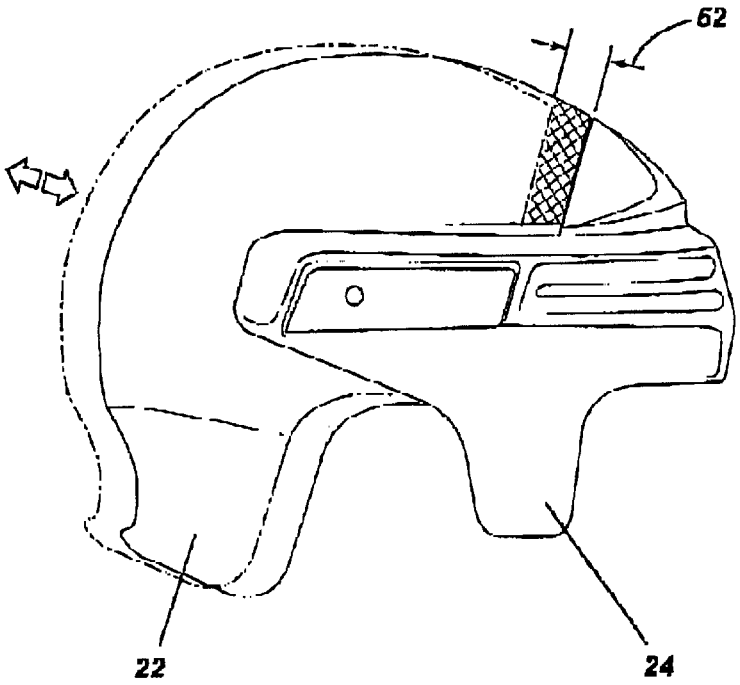
FIG. 3 is a side elevational view of the two shells making up an adjustable protective helmet with dotted lines showing the relative motion between the shells.

As shown in FIG. 3, front and back shell 22 and 24 are movable relative to one another. The dotted lines illustrate helmet 20 in its two extreme positions. The distance 57 represents the general range of motion, which also corresponds to overlapping portions 46 and 47 shown in FIG. 2. Inner overlapping portion 47 is lying inwardly relative to overlapping portion 46 and its associated back shell 22. Both overlapping portions 46 and 47 extend transversely across the top portion of the wearer's head.

Figure 4:
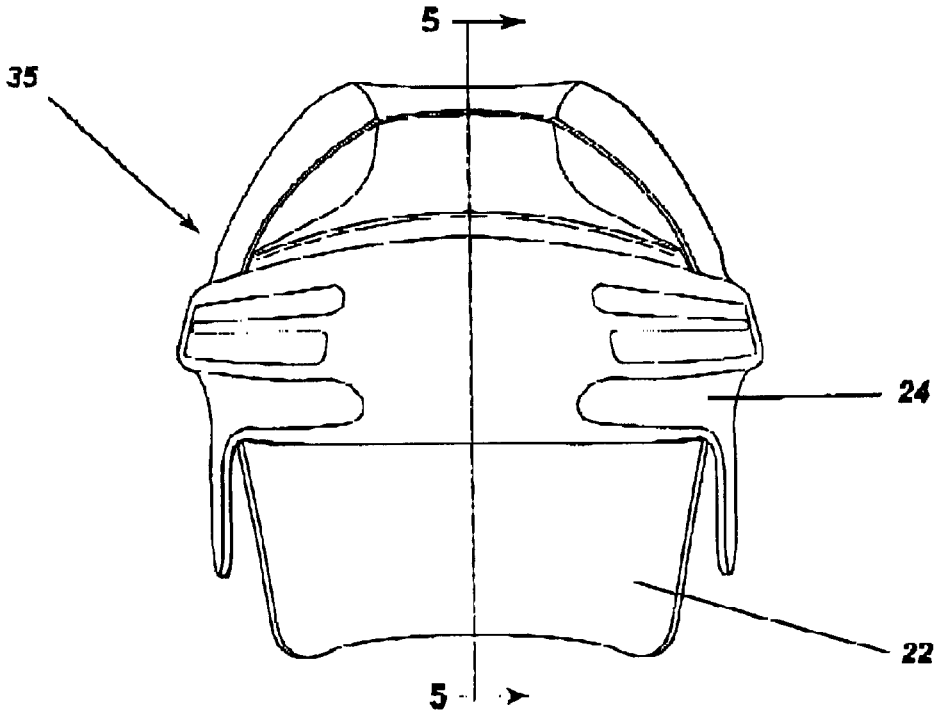
FIG. 4 is a front elevational view of the adjustable protective helmet in the small adjustment position according to an embodiment of the invention.
Figure 5:
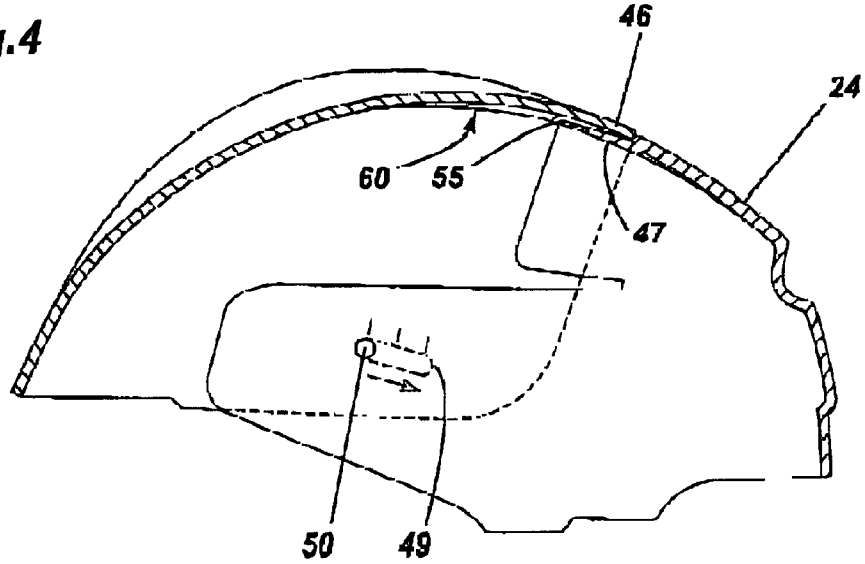
FIG. 5 is a cross-sectional view taken at line 5—5 of FIG. 4 showing the overlapping portions of the adjustable protective helmet in the small adjustment position according to an embodiment of the invention.
Figure 6:
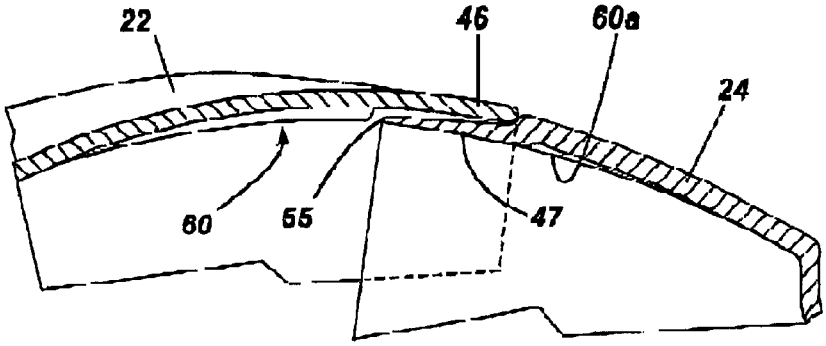
FIG. 6 is a partial view of section 5—5 showing details of the shell assembly according to an embodiment of the invention.

FIG. 4 is a frontal view of shell assembly 35 in the closed position. Referring to FIGS. 5 and 6 which are cross sections taken at line 5—5 of FIG. 4, it can be seen that the juxtaposition of overlapping portions 46 and 47 creates a step or ridge 55 on the interior surface of shell assembly 35. Step 55 is in fact the front lip of overlapping portion 47 protruding inside shell assembly 35. The interior curvature of shell assembly 35 is therefor partially broken by overlapping portions 46 and 47 which creates a zone of force concentration during an impact to the head. In order to minimize the force concentration effect of step 55, a ramp 60 is added on the interior surface of back shell 22, immediately adjacent overlapping portions 46 and 47 and facing the free edge of inner overlapping portion 47. thereby re-establish the smooth interior curvature of shell assembly 35. Ramp 60 is configured to increase the surface area in direct contact between shell assembly 35 and liner 19 in order to reduce the force concentration around step 55 that would result from an impact.

Figure 7:
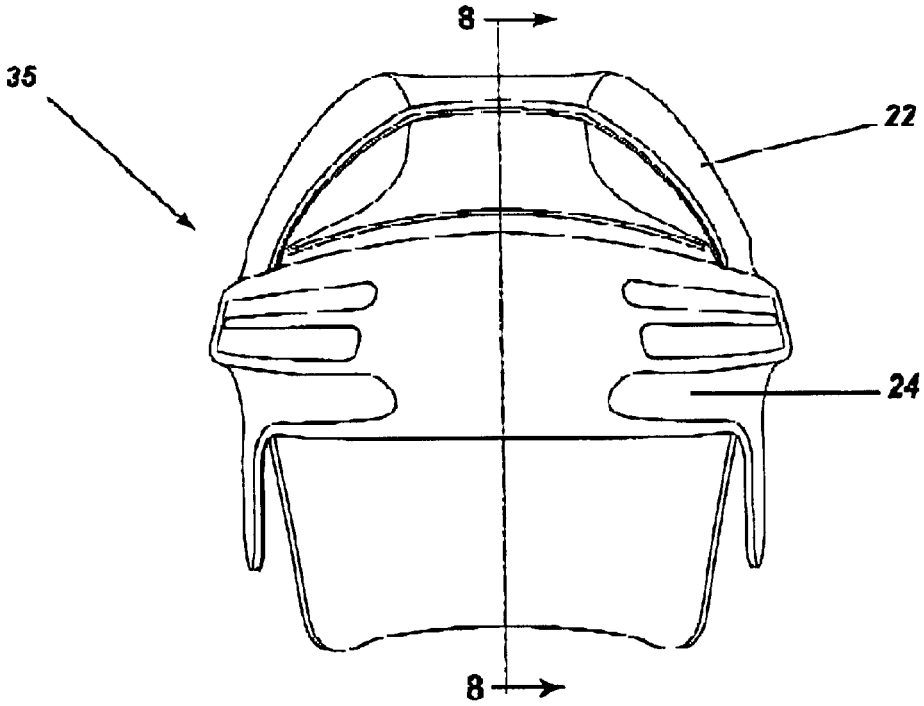
FIG. 7 is a front elevation view of the adjustable protective helmet in the large adjustment position according to an embodiment of the invention.
Figure 8:
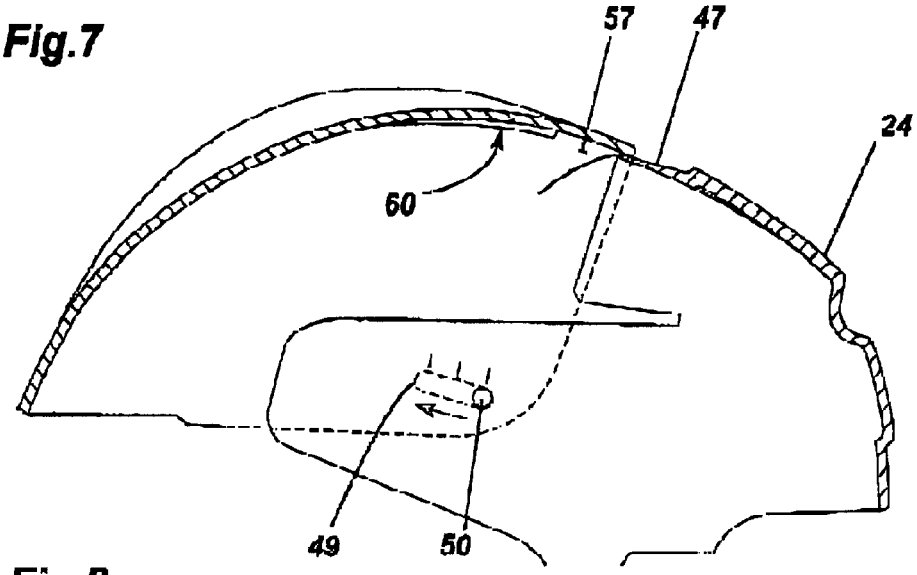
FIG. 8 is a cross-sectional view taken at line 8—8 of FIG. 7 showing the overlapping portions of the adjustable protective helmet in the large adjustment position according to an embodiment of the invention.
Figure 9:
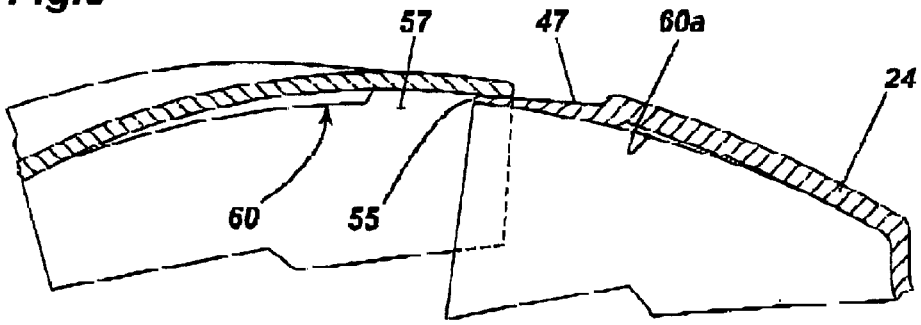
FIG. 9 is a partial view of section 8—8 showing details of the shell assembly according to an embodiment of the invention.

FIGS. 7, 8 and 9 show shell assembly 35 in its wide-open position. As shown more clearly in FIG. 9, a gap 57 is opened by the large size adjustment of helmet 20. Again, in this position, ramp 60 serves as a pedestal which is at the same level or height as step 55 so that liner 19 may at least partially bridge gap 57 along a single plane coinciding with the interior curvature of shell assembly 35 thereby minimizing the force concentration of an impact in this region. With reference to FIGS. 6 and 9, the inner surface of front shell 24 may also be provided with a ramp BOa to conform its profile to the inner curvature of shell assembly 35.

Figure 10:
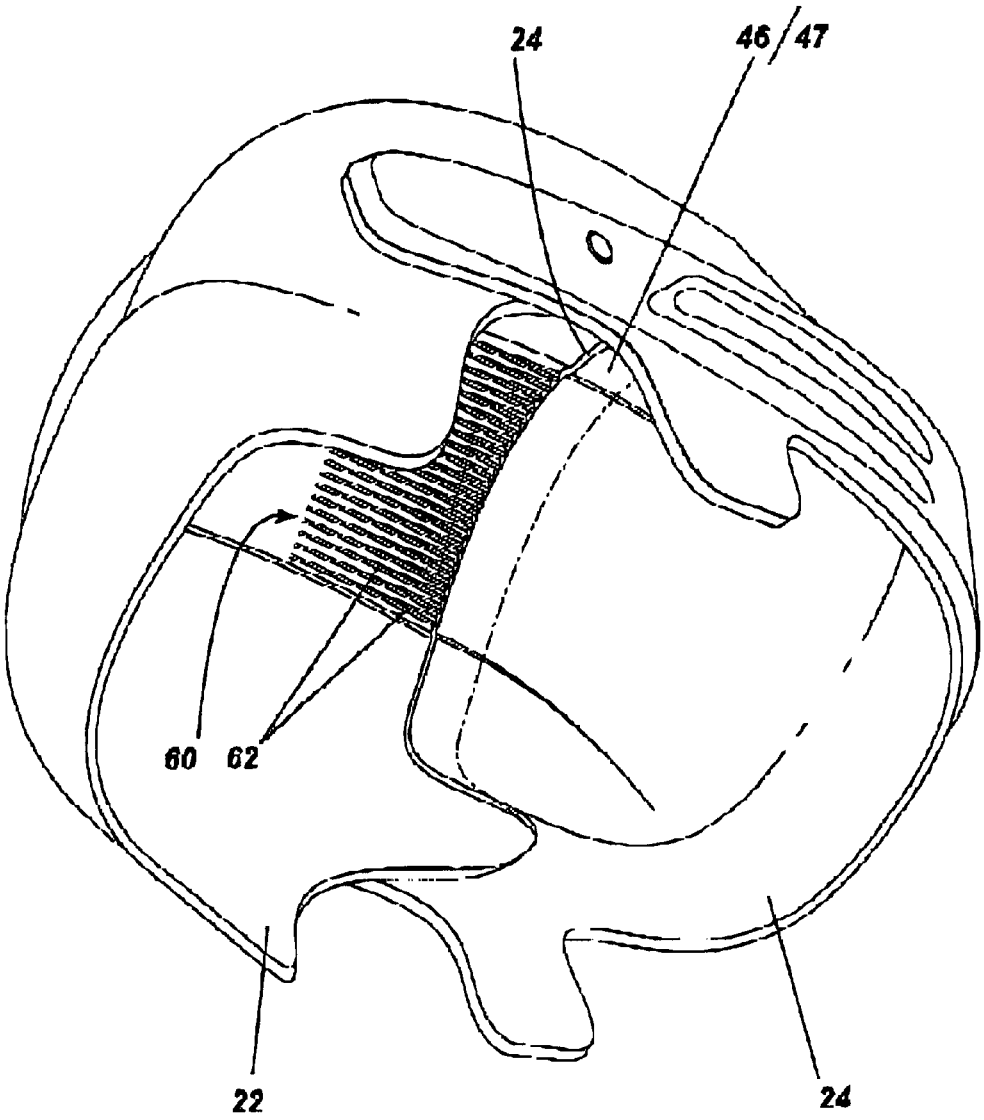
FIG. 10 is a perspective view of the interior surfaces of the adjustable protective helmet according to an embodiment of the invention.
Figure 11:
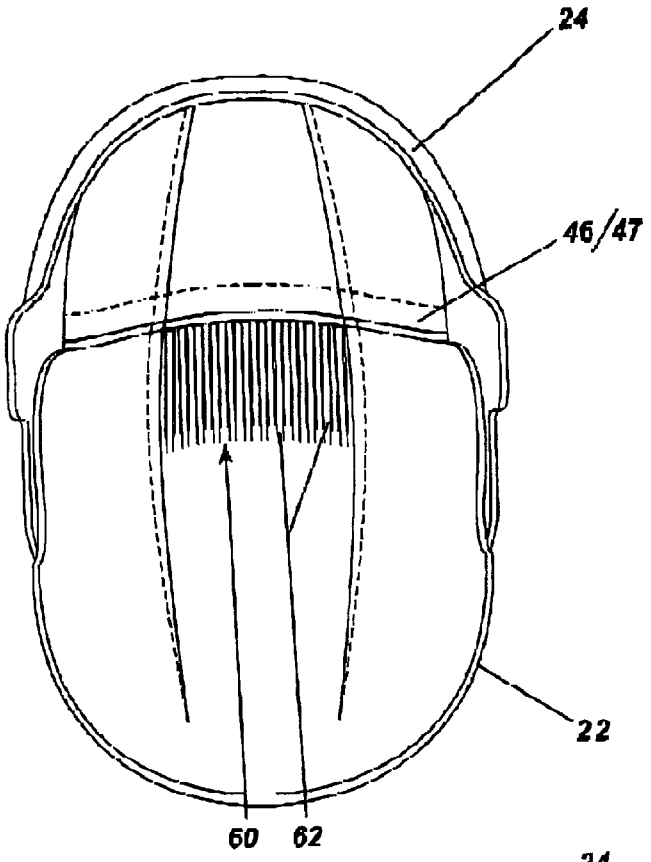
FIG. 11 is a bottom plan view of the inside of the adjustable protective helmet showing a first embodiment of the raised formations according to the invention.

As shown in FIGS. 10 and 11, ramp 60 is located in the central portion of shell assembly 35 and more specifically adjacent to overlapping portion 46 of rear shell 22 such that the frontal edge of ramp 60 faces the rear edge 61 of front shell 24. Ramp 60 is defined by a series of raised formations 62 shaped as longitudinal ribs decreasing in height from overlapping portion 47 to blend with an inner curvature of shell assembly 35. The rib arrangement offers a method of increasing the thickness of the shell in ramp 60 area without creating visible sink marks on the outside surface of the shell during the molding of shells 22 and 24. An increase in thickness of a specific portion of a molded product usually results in a poor finish of the molded parts. The rib arrangement minimizes the increase in thickness while providing the desired profile to reduce the force concentration on impact.

Figure 12:
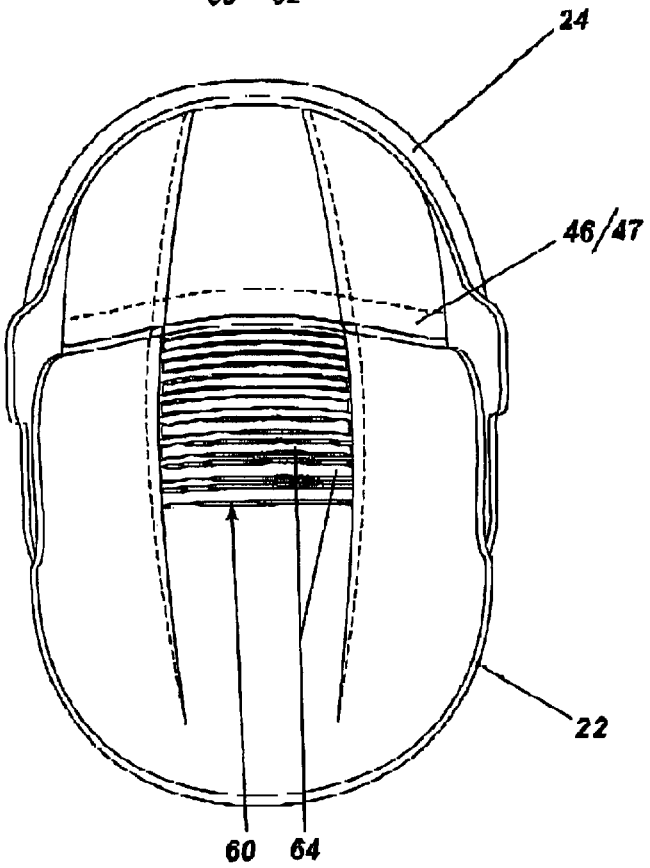
FIG. 12 is a bottom plan view of the inside of the adjustable protective helmet showing a second embodiment of the raised formations according to the invention.
Figure 13:
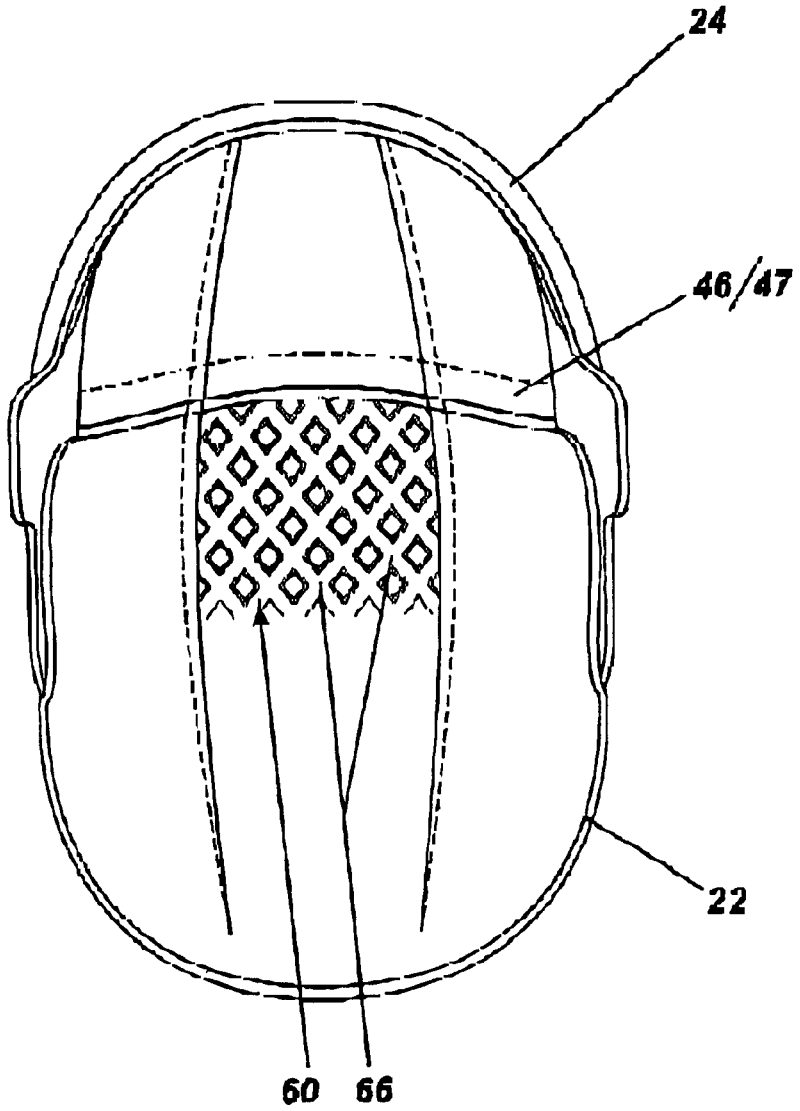
FIG. 13 is a bottom plan view of the inside of the adjustable protective helmet showing a third embodiment of the raised formations according to the invention.

FIGS. 12 and 13 illustrate variations of the same theme. In FIG. 12, Ramp 60 is defined by lateral ribs 64, which decrease in height from the first one closest to overlapping portions 46 and 47 to achieve the required profile of the interior curvature of shell assembly 35. In FIG. 13, Ramp 60 is defined by a criss-cross pattern of ribs 66, again of decreasing heights from overlapping portions 46 and 47 to blend with the interior curvature of shell assembly 35. Similarly, if a ramp 60 is used on the inner surface of front shell 24, the raised formations may be of any configuration as those previously described. The pattern of ribs may vary without departing from the spirit of the invention.

In combination with ramp 60, a dual density liner made of a hardback foam and a softer foam may be used. The hardback portion of the dual density liner is positioned directly against the interior surface of shell 22 and 24 to provide a strong bridging effect when front and back shells 22 and 24 are separated by a large gap 67 as shown in FIGS. 8 and 9. The hardback portion also helps to present a smooth surface for the softer shock-absorbing foam by smoothing out the irregularities of the interior surface of shells 22 and 24 especially around overlapping portions 46 and 47. The hardback foam is located between the shell assembly 35 and the softer foam to reduce the risk of "bottoming out" the foam. Foam "bottoming out" occurs when the compression of the foam during impact reaches a point where further compression would drastically increase the force required. The hardback foam raises this point and by doing so, increase the shock absorbing role of the softer foam during impact.

Figure 14:
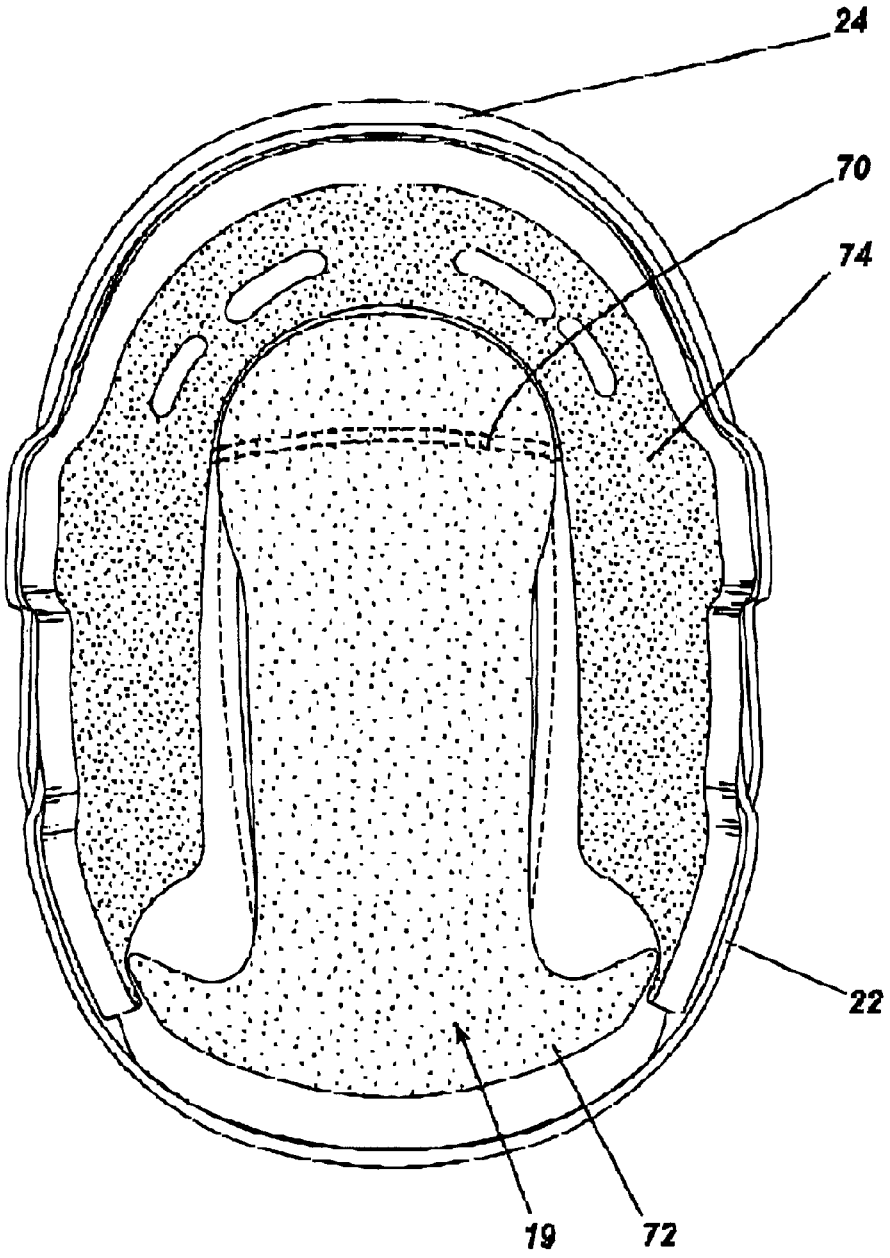
FIG. 14 is a bottom plan view of the inside of the adjustable protective helmet showing the a first pattern of the liner of shock absorbing padding according to an embodiment of the invention.
Figure 15:
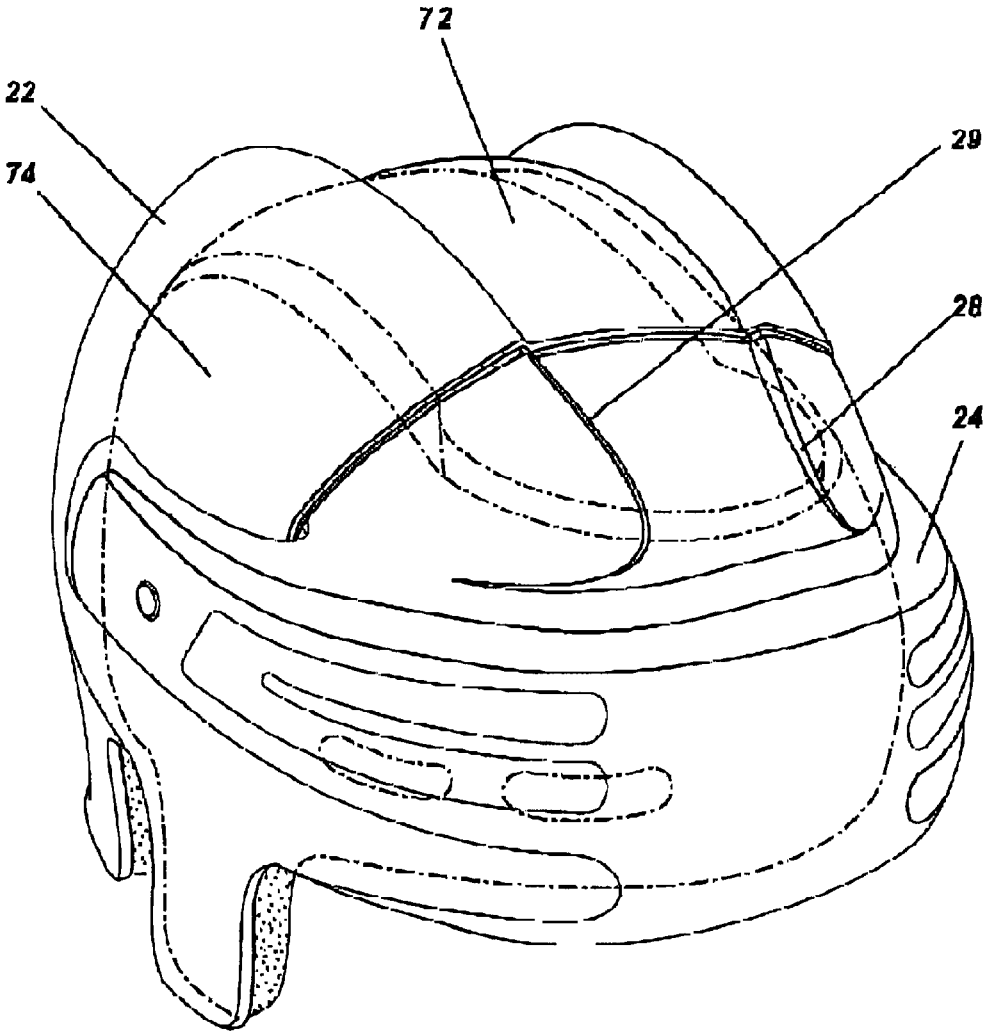
FIG. 15 is a side perspective view of the adjustable protective helmet showing the liner pattern of FIG. 14 in dotted lines.

FIGS. 14 and 15 illustrate a first pattern of laying out shock absorbing liner 19 inside shell assembly 35. Liner 19 is divided into two sections of padding: a first padding section 72, which covers the back portion and the top portion of the wearer's head, and a second padding section 74, which covers the forehead and both sides of the head. Padding sections 72 and 74 are separated at the front of helmet 20, in a region that does not coincide with the separation of front and back shells 22 and 24 which is depicted by dotted line 70. In this manner, the separation of padding sections 72 and 74 when shell assembly is adjusted is located in a less critical impact-absorbing zone than at the separation zone 70 where front and back shells 22 and 24 meet and overlap. More specifically, FIG. 15 show that the separation of padding sections 72 and 74 is located in an area of increased geometry formed by front portion of ridges 28 and 29 of front shell 24. This arrangement further minimizes the negative effect of having padding separation caused by the adjustability of helmet 20.

Figure 16:
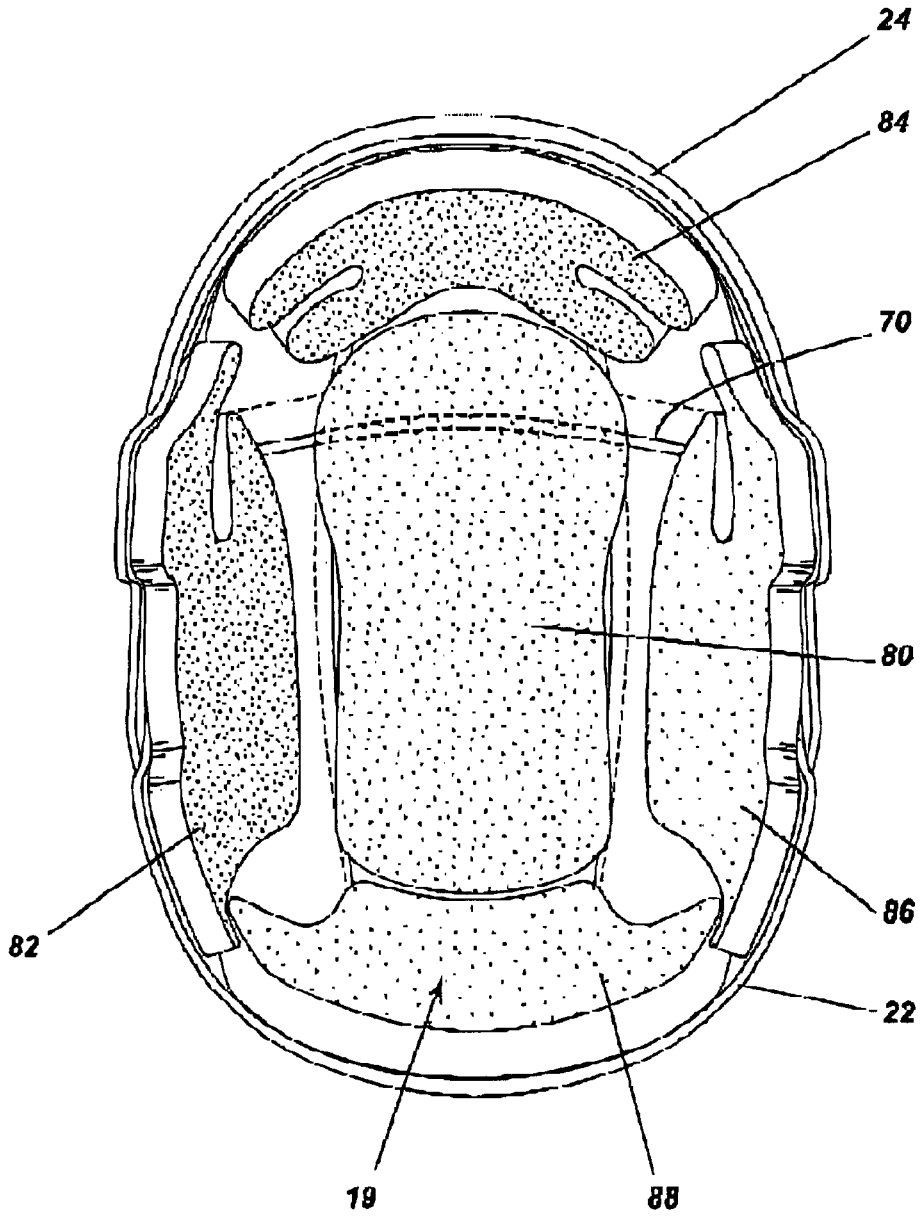
FIG. 16 is a bottom plan view of the inside of the adjustable protective helmet showing the a second pattern of the liner of shock absorbing padding according to an embodiment of the invention.
Figure 17:
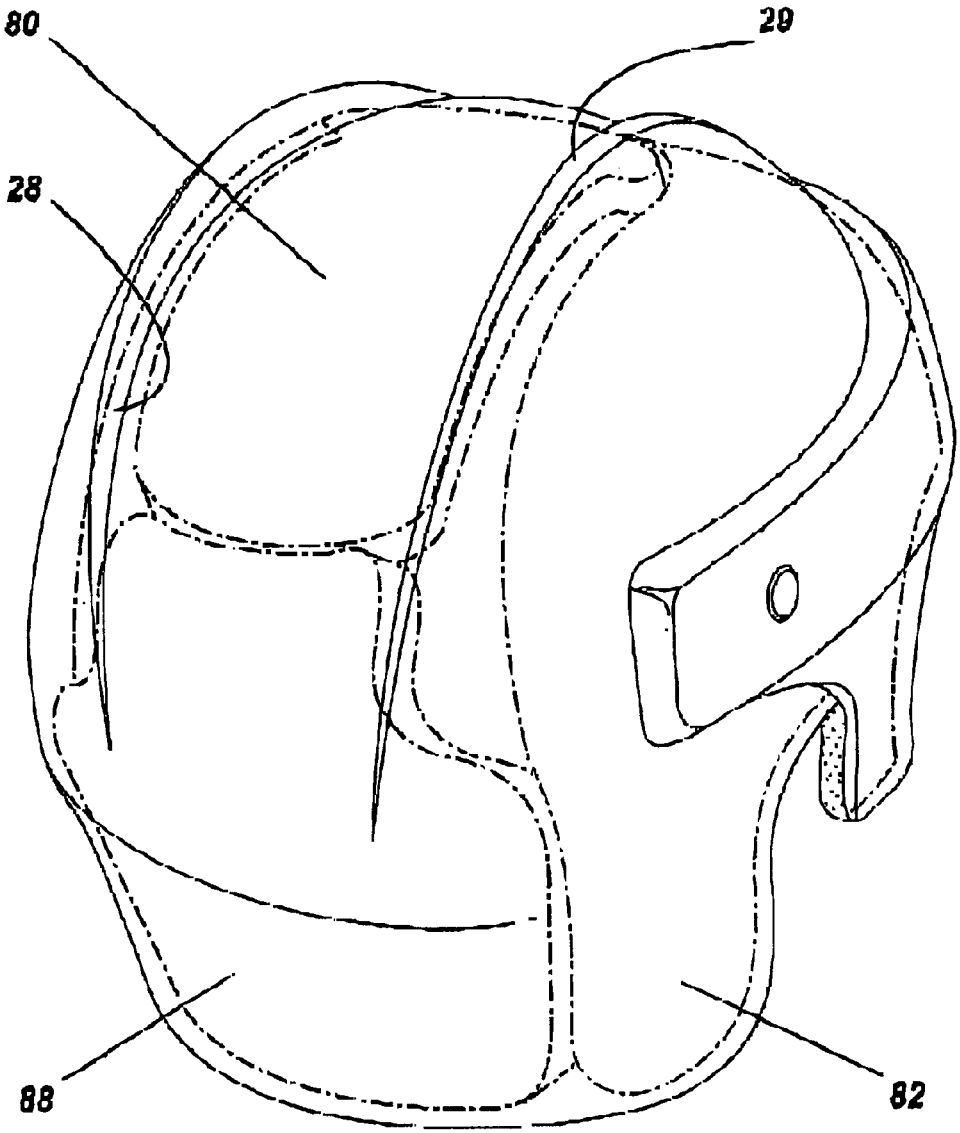
FIG. 17 is a rear perspective view of the adjustable protective helmet showing the liner pattern of FIG. 16 in dotted lines.

FIGS. 16 and 17 illustrates another pattern of shock absorbing liner 19 inside shell assembly 35. Liner 19 is divided into five padding sections 80, 82, 84 86 and 88. Again, padding sections 80 and 84, are separated at the front of shell assembly 35, in a region that does not coincide with the separation of front and back shells 22 and 24 which is depicted by dotted line 70. Futhermore, as is shown in FIG. 17, padding sections 80 and 88 are separated in an area of increased geometry formed by rear portion of ridges 28 and 29 which minimizes the negative effect of having padding separation. The separation of padding section 80 with the side padding sections 82 and 86 is also located directly below ridges 28 and 29. The location of each padding sections such that they are separated in areas of front and back shells 22 and 24 which present increased geometry provides a helmet with more efficient impact absorption.

The above description of preferred embodiments should not be interpreted in a limiting mannor since other variations, modifications and refinements are possible within the spirit and scope of the present invention. The scope of the invention is defined in the appended claims and their equivalents.

What is claimed is:

1. An adjustable protective helmet for sporting activities comprising a first shell and second shell, one of said shells covering the forehead and a portion of the sides of a wearer's head, and the other one of said shells covering the top, back and a portion of the sides of a wearer's head; said first and second shells having respective cooperating inner and outer overlapping portions extending transversely across the top portion of the wearer's head for connecting together said shells to form a bowl shaped shell assembly circumscribing the wearer's head: said inner overlapping portion lying inwardly of said outer overlapping portion and its associated shell; said shells movable relative to one another in said overlapping portions to provide size adjustability of said helmet; said helmet including a shock absorbing liner inside said shell assembly; said shell assembly comprising a ramp defined by a plurality of raised formations on the inside surface of said shell assembly, said ramp adjacent and facing a free edge of said inner overlapping portion thereby increasing the contact surface area between said liner and said shell assembly around said overlapping portions in order to reduce the concentration of force of an impact in the vicinity of said overlapping portions.

2. An adjustable protective helmet as defined in claim 1 wherein said ramp is located in the central portion of said inside surface of said shell assembly.

3. An adjustable protective helmet as defined in claim 2 wherein said raised formations define a plan substantially co-planar with a plan defined by the inside surface of said inner overlapping portion.

4. An adjustable protective helmet as defined in claim 3 wherein said raised formations are a series of ribs extending from said overlapping portions.

5. An adjustable protective helmet as defined in claim 4 wherein said series of ribs decreases in height from said overlapping portions to blend with an inner curvature of said shell assembly.

6. An adjustable protective helmet as defined in claim 3 wherein said raised formations extend longitudinally from said overlapping portions.

7. An adjustable protective helmet as defined in claim 6 wherein said raised formations extend substantially perpendicular to said overlapping portions.

8. An adjustable protective helmet as defined in claim 4 wherein said ramp is a means for providing a smooth inner curvature of said inside surface of said shell assembly.

9. An adjustable protective helmet as defined in claim 3 wherein said ramp defined by a plurality of raised formations laid out in a criss-cross pattern.

10. An adjustable protective helmet as defined in claim 1 wherein said liner is made of a foam material.

11. An adjustable protective helmet as defined in claim 10 wherein said liner is made of dual density having a hard back foam contacting said shell assembly and a softer foam contacting the wearer's head.

12. An adjustable protective helmet as defined in claim 10 wherein said liner comprises a plurality of foam material sections juxtaposed to each other to substantially cover said inside surface of said shell assembly.

13. An adjustable protective helmet as defined in claim 12 wherein said sections are juxtaposed to each other in a location ahead of said overlapping portions.

14. An adjustable protective helmet as defined in claim 12 wherein said sections are juxtaposed to each other in a location behind of said overlapping portions.

* * * * *